US011219937B2

(12) United States Patent
Lopez Lage et al.

(10) Patent No.: US 11,219,937 B2
(45) Date of Patent: Jan. 11, 2022

(54) CENTERING AND SELECTIVE HEATING

(71) Applicant: AUTOTECH ENGINEERING S.L., Amorebieta-Etxano (ES)

(72) Inventors: Manuel Lopez Lage, Sant Esteve Sesrovires (ES); Jordi Castilla Moreno, Sant Esteve Sesrovires (ES); Daniel Merino Fernandez, Sant Esteve Sesrovires (ES); Oliver Straube, Ludwigsfelde (DE)

(73) Assignee: AUTOTECH ENGINEERING S.L., Amorebieta-Etxano (ES)

( * ) Notice: Subject to any disclaimer, the term of this patent is extended or adjusted under 35 U.S.C. 154(b) by 18 days.

(21) Appl. No.: 16/099,411

(22) PCT Filed: Aug. 8, 2017

(86) PCT No.: PCT/EP2017/070015
§ 371 (c)(1),
(2) Date: Nov. 6, 2018

(87) PCT Pub. No.: WO2018/029169
PCT Pub. Date: Feb. 15, 2018

(65) Prior Publication Data

US 2019/0193134 A1 Jun. 27, 2019

(30) Foreign Application Priority Data

Aug. 9, 2016 (EP) ..... 16382394

(51) Int. Cl.
*B21D 22/02* (2006.01)
*C21D 9/46* (2006.01)
(Continued)

(52) U.S. Cl.
CPC ..... *B21D 22/022* (2013.01); *B21D 37/16* (2013.01); *C21D 1/18* (2013.01); *C21D 1/34* (2013.01);
(Continued)

(58) Field of Classification Search
CPC ..... B21D 22/022; B21D 37/16; C21D 1/18; C21D 1/34; C21D 2221/00; C21D 9/46
(Continued)

(56) References Cited

U.S. PATENT DOCUMENTS 8,382,084 B2 * 2/2013 Gerber ..... B21D 43/003 269/55
8,555,507 B2 * 10/2013 Lee ..... C21D 1/42 148/330
(Continued)

FOREIGN PATENT DOCUMENTS

CN 203470711 * 3/2014 ..... B21D 22/022
EP 2143808 A1 1/2010
(Continued)

OTHER PUBLICATIONS

International Search Report for PCT/EP2017/070015, dated Nov. 20, 2017.

*Primary Examiner* — Jessee R Roe
*Assistant Examiner* — Michael Aboagye
(74) *Attorney, Agent, or Firm* — Squire Patton Boggs (US) LLP

(57) ABSTRACT

Centering systems for centering blanks outputted from a furnace in a hot stamping line are provided, the centering system comprising a centering table and a heating system for heating one or more selected zones of the blank while arranged on the centering table. Also provided are methods for manufacturing steel components having hard zones and soft zones, wherein the soft zones are of less mechanical
(Continued)

strength than the hard zones. The methods comprise heating a steel blank in a furnace, centering the heated blank on a centering table arranged downstream from the furnace, heating one or more selected zones of the heated blank while the blank is on the centering table, wherein the selected zones are the zones of the blank which are destined to form the hard zones; transferring the blank to a press tool to hot forming the blank, and quenching the selected zones of the blank destined to form the hard zones.

16 Claims, 3 Drawing Sheets

(51) Int. Cl.

| | |
|---|---|
| ***C21D 1/18*** | (2006.01) |
| ***B21D 37/16*** | (2006.01) |
| ***C21D 1/34*** | (2006.01) |
| *C21D 9/00* | (2006.01) |
| *C21D 1/673* | (2006.01) |

(52) U.S. Cl.
CPC ..... *C21D 9/46* (2013.01); *C21D 1/673* (2013.01); *C21D 9/0068* (2013.01); *C21D 2221/00* (2013.01)

(58) Field of Classification Search
USPC ..... 266/249; 148/546, 643, 644, 559.639, 148/641, 657, 661; 432/250; 269/55, 60, 269/289 R
See application file for complete search history.

(56) References Cited

U.S. PATENT DOCUMENTS

| | | | | |
|---|---|---|---|---|
| 9,631,248 | B2 * | 4/2017 | Hwang | C21D 8/0205 |
| 10,612,108 | B2 * | 4/2020 | Haslmayr | C21D 9/46 |
| 2009/0320968 | A1 * | 12/2009 | Boeke | C21D 1/34 148/546 |
| 2010/0300584 | A1 * | 12/2010 | Buschsieweke | F27B 9/028 148/530 |
| 2011/0283851 | A1 * | 11/2011 | Overrath | B21D 22/00 83/15 |
| 2014/0083572 | A1 | 3/2014 | Schwartz | |
| 2015/0377556 | A1 * | 12/2015 | Ishiguro | C21D 8/02 148/565 |
| 2017/0037489 | A1 | 2/2017 | Schwartz | |

FOREIGN PATENT DOCUMENTS

| | | | |
|---|---|---|---|
| EP | 2497840 | A1 | 9/2012 |
| WO | WO 2010/081660 | A1 | 7/2010 |

* cited by examiner

CENTERING AND SELECTIVE HEATING

The present disclosure relates to centering systems for blanks, in particular to centering systems including a heating system. The present disclosure further relates to methods for manufacturing steel components including hot forming of blanks.

BACKGROUND

In the automotive industry, the development and implementation of lightweight materials or components is becoming more important in order to satisfy criteria for manufacturing lighter vehicles. The demand for weight reduction is especially driven by the goal of reduction of $CO_2$ emissions. Additionally, the growing concern regarding occupant safety also leads to the adoption of materials which improve the integrity and the energy absorption of the vehicle during a crash.

Hot stamping is a process which allows manufacturing hot formed structural components with specific properties which may include features such as a high strength, reduced thickness of components and lightness.

In a hot stamping production line system, a furnace system heats steel blanks at a predetermined temperature, e.g. above an austenization temperature, particularly above Ac3 and softens the blanks to be hot formed. As the blanks exit the furnace, the blanks need to be correctly positioned in order to be correctly transferred to the press tools, which are configured to press the blanks.

The transfer from the exit region of the furnace to the press tool may be done by a conveyor and/or a transferring system. Such a conveyor system usually comprises a centering system, also known as centering table, to correctly place the heated blanks before being transferred to the press tool.

A conveyor system in such a production line is configured to convey blanks to and through a furnace. The furnace and the conveyor system are configured such that the blanks are heated to a desired temperature and for a desired time period (e.g. 3-5 minutes) before exiting the furnace. The transportation of the components through the furnace takes place on e.g. roller conveyors.

After centering, the blanks are transferred to a press system which deforms the blanks to the shape of the end product. After the press step, post operations such as calibrating or drilling holes may be performed.

Typically in the automotive industry, high strength steel or Ultra High Strength Steel (UHSS) blanks are used for manufacturing components of a structural skeleton. The structural skeleton of a vehicle, e.g. a car, in this sense may include e.g. a bumper, pillars (A-pillar, B-pillar, C-pillar), side impact beams, a rocker panel, and shock absorbers.

UHSS can exhibit an optimized maximal strength per weight unit and advantageous formability properties. UHSS may have an ultimate tensile strength of at least 1000 MPa, preferably approximately 1500 MPa or up to 2000 MPa or more.

The steel blanks can obtain a suitable microstructure with high tensile strength by cooling the blanks in the press or after the press. Depending on the composition of the base steel material, blanks may need to be quenched, i.e. be cooled down rapidly from a high temperature to a low temperature, to achieve a high tensile strength.

An example of steel used in the automotive industry is 22MnB5 steel. The composition of 22MnB5 is summarized below in weight percentages (rest is iron (Fe) and impurities):

| C | Si | Mn | P | S | Cr | Ti | B | N |
|---|---|---|---|---|---|---|---|---|
| 0.20-0.25 | 0.15-0.35 | 1.10-1.35 | <0.025 | <0.008 | 0.15-0.30 | 0.02-0.05 | 0.002-0.004 | <0.009 |

Several 22MnB5 steels are commercially available having a similar chemical composition. However, the exact amount of each of the components of a 22MnB5 steel may vary slightly from one manufacturer to another. In other examples the 22MnB5 may contain approximately 0.23% C, 0.22% Si, and 0.16% Cr. The material may further comprise Mn, Al, Tl, B, N, Ni in different proportions.

Usibor® 1500P commercially available from Arcelor Mittal, is an example of commercially available steels used in tailored and patchwork blanks. Tailor (welded) blanks and patchwork blanks provide a blank with varying thickness or different material properties prior to a deformation process e.g. hot stamping. Reinforcements in this sense instead are added to a component after a deformation process.

Usibor® 1500P is supplied in ferritic-perlitic phase. It is a fine grain structure distributed in a homogenous pattern. The mechanical properties are related to this structure. After heating, a hot stamping process, and subsequent quenching, a martensite microstructure is created. As a result, maximal strength and yield strength increase noticeably.

The composition of Usibor is summarized below in weight percentages (rest is iron (Fe) and impurities):

| C | Si | Mn | P | S | Cr | Ti | B | N |
|---|---|---|---|---|---|---|---|---|
| 0.24 | 0.27 | 1.14 | 0.015 | 0.001 | 0.17 | 0.036 | 0.003 | 0.004 |

Steels of any of these compositions (22MnB5 steels in general, and Usibor in particular) may be supplied with a coating in order to prevent corrosion and oxidation damage. This coating may be e.g. an aluminum-silicon (AlSi) coating or a coating mainly comprising zinc or a zinc alloy.

The increase in a component strength obtained by these processes and materials may allow for a thinner gauge material to be used, which results in weight savings over conventionally cold stamped mild steel components for automotive applications.

In order to improve the ductility and energy absorption in key areas of a component such as a B-pillar, it is known to introduce softer regions within the same component. These softer regions or soft zones improve ductility locally while maintaining the required high strength overall. By locally tailoring the microstructure and mechanical properties of certain structural components such that they comprise regions with very high strength (hard zones) and regions with increased ductility (soft zones), it may be possible to improve their overall energy absorption while maintaining their structural integrity during a crash and also reducing their overall weight.

Herein, "hard zone" is to be understood as a zone of the component which primarily has a martensitic microstructure, and a high ultimate tensile strength, e.g. 1.100 MPa or more, in particular, approximately 1.400 MPa or more.

"Soft zone" is to be understood as a zone of a component in which the steel has a less martensitic microstructure than the hard zone and a lower ultimate tensile strength, e.g. of approximately 1.050 MPa or less. The microstructure of a soft zone may be, depending on the grade, e.g. a combination of bainite and martensite, of bainite, of martensite and ferrite or of ferrite and perlite.

Known methods of creating different ductility zones in vehicle structural components include providing tools e.g. a furnace or a pressing tool, comprising a plurality of pairs of complementary upper and lower units, each of the units having separate elements (steel blocks). Each separate element pair is designed to work at different temperatures, in order to have different heating/cooling rates in different zones of the blank, and thereby resulting in different material properties in the final product.

However, such die elements cannot be easily changed to a new configuration i.e. they do not have a good adaptability if the design or the location of a soft zone changes. Moreover, the adaptation of e.g. sensors and heaters in the die can be expensive.

Other known methods to create different ductility regions are based on heating the blank with e.g. a laser or induction heater after hot forming and quenching the blank. However, these methods add a further processing step, which increases the costs and makes the manufacturing process more time consuming.

In conclusion, there is a need for methods and tools for creating zones in a component with different microstructures (i.e. hard zones and soft zones) which at least partially solve some of the aforementioned problems.

SUMMARY

In a first aspect, a centering system for centering blanks outputted from a furnace in a hot stamping line is provided. The centering system comprises a centering table, and a heating system for heating one or more selected zones of the blank while arranged on the centering table.

The heating system may comprise a base and a plurality of heating elements, such as, infrared heaters, induction heaters, laser heaters, preferably diode laser heaters, or resistive heaters, arranged in said base. The centering system may further comprise a support structure that may be used for coupling the base to the centering table. In some examples, the support structure may be arranged for anchoring the base on a floor or for suspending the base from a ceiling or from a wall, e.g. a furnace wall In a further aspect of the present invention, the base of the heating system may comprise at least one contacting element (e.g. a plate) heated by the heating elements, with the purpose of transferring the heat from the at least one contacting element to the blank via direct contact (i.e. via heat conduction), preferably wherein the temperature of the at least one contacting elements that is in direct contact with the blank ranges between 850 to 1000° C.

In a further aspect of the present invention, the heating elements are configured to be selectively switched on.

In another aspect of the present invention, the heating elements are arranged with respect to the centering table in such a way that substantially only the selected zones of the blank are heated.

In a still further aspect, the centering system of the present invention further comprises a cooling system for cooling one or more zones of the blank that are not selected for heating.

In a further aspect, a method for manufacturing a steel component having hard zones and soft zones is provided. Herein, the soft zones are of less mechanical strength than the hard zones. The method comprises heating a steel blank in a furnace, centering the heated blank on a centering table arranged downstream from the furnace, and heating one or more selected zones of the heated blank while the blank is on the centering table. Herein, the selected zones are the zones of the blank which are destined to form the hard zones. Then, the blank is transferred to a press tool to be hot formed. The selected zones may be quenched to obtain a martensite microstructure as a result.

The use of a centering table with a heating system enables a new processing step to be added to the hot forming processing line without substantially increasing processing time and without needing complicated press tools. The time needed for centering the blanks as they exit a furnace is used to selectively let some zones of the blank to cool down whereas other zones are not allowed to cool down to the same extent. The cooler zones will lead to a softer zone, whereas the hotter zones will lead to harder zones in the final component. This is because the hotter zones will be quenched: they rapidly cool down from a high temperature (e.g. 700° C. or more) to a low temperature (e.g. 300° C. or less) at which it is removed from the press tool. The cooling rate for the hotter zones can be above the critical cooling rate so that martensite is formed. In some examples, the cooling rate may be 40° C./s or 50°/s or more. In some examples, the critical cooling rate may be 25-30° C./s approximately. In a further aspect of the method of the present invention, the temperature of the blank in the press form tool is reduced to 250° C. or lower, preferably to 200° C. or lower.

For the zones of the blank that have started cooling down less martensite is formed because the cooling in the press tool (which may be more rapid than the cooling outside the press tool) starts at a lower temperature. The soft zone may have a microstructure comprising e.g. a combination of bainite and martensite, or of bainite, of martensite and ferrite or of ferrite and perlite. The rapid cooling rate for the zones that have started cooling down may be e.g. 25° C./s or more.

As zones with different mechanical properties i.e. soft zones and hard zones, are created when the blanks are substantially flat a higher control and flexibility for the design of soft zones may be obtained.

In a continuous manufacturing process the time used for centering one blank may coincide with the time used for quenching a previous blank in a press tool. The methods and systems herein described take advantage of this time span for selective heating. The cycle time does therefore not need to be increased to incorporate the forming of harder and softer zones.

In some examples, the time that the blanks are maintained in the furnace may be shortened, since the final heating can take place in the centering table.

In a further aspect, the method of the present invention comprises heating the blank in the furnace above an Ac3 temperature of the steel of the blank. In the centering system, the selected zone of the blank are preferably heated above the heating temperature of the furnace.

In another aspect, the method of the present invention comprises heating one or more selected zones of the blank while the blank is on the centering table further comprises a cooling system (101 of FIG. 3*b*) for cooling of one or more zones of the blank that are not selected for heating, preferably wherein said one of more zones of the blank, that are not selected to be heated, have a temperature ranging between 450° C. and 700° C. when the blank is transferred to the press tool.

In a further aspect, in the method of the present invention, the blanks may remain on the centering table for a period of 15 seconds or less, preferably for 10 seconds or less.

BRIEF DESCRIPTION OF THE DRAWINGS

Non-limiting examples of the present disclosure will be described in the following, with reference to the appended drawings, in which.

DETAILED DESCRIPTION

Figure 1:
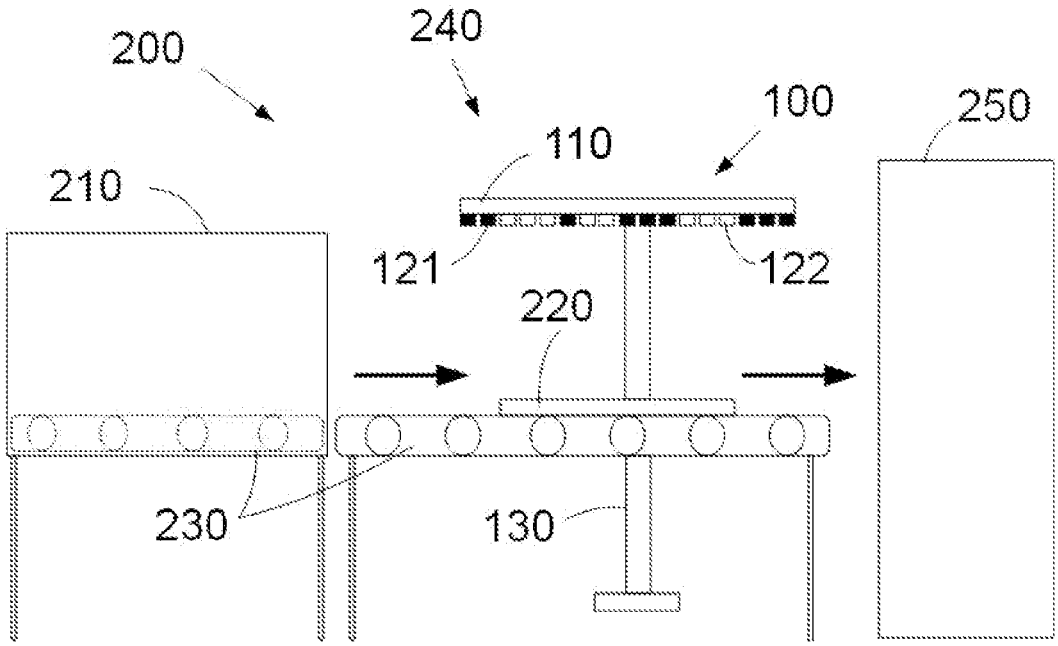
FIG. 1 schematically illustrates a side view of a hot forming production line according to an example.

FIG. 1 shows a blank 220 in a hot forming production line 200. The blank 220 may be conveyed through the furnace 210 by a conveyor system 230 e.g. comprising a plurality of conveyor rollers or a conveyor belt, wherein the speed of the conveyor may be controlled by motors. The blank 220 may be heated to a predetermined temperature, e.g. above an austenization temperature, in the furnace so as to prepare the blank 220 for subsequent processes. Depending on the material of the blank, the temperature in the furnace 210 and the time the blanks have to remain in the furnace can vary. In some examples, the blanks are heated above Ac3 temperature for 5 to 10 minutes.

The heated blank 220 may exit the furnace 210 through a door (not shown) configured to open when the blank 220 arrives, and to close again when the blank 220 has left the furnace 210. The blank 220 may be transported by a conveyor system 230, e.g. a conveyor belt or a roller conveyor, to a centering system 240. e.g. a centering table, to be correctly positioned for subsequent processes.

A centering table 240 may comprise a plurality of centering pins (not shown) which can be passive or can be actively moved to correctly position and center the blanks. After centering, the blanks may be picked up by e.g. a robot and transferred to a press tool 250 arranged downstream from the centering system.

While the blank 220 is in the centering table 240 it may be subjected to a selective heating which enables the creation of different ductility zones, i.e. hard zones and soft zones, subsequently in the press tool. Zones selected to be hard zones may be selectively heated in order to maintain the temperature at which the blank is been heated, i.e. furnace temperature ($T_f$), after exiting the furnace 210. In some alternative examples, the temperature of the zones of the blank which are destined to be hard zones may even be raised above the furnace temperature.

Arranged with the centering table 240 there may be a heating system 100 which may comprise heating elements 121, 122 arranged in a base 110. A further support structure 130 may be used to fix the base 110 of the heating system 100 to the floor.

In other examples the heating system 100 may be anchored to the centering table 240, suspended from the ceiling or from a wall e.g. a furnace wall.

In some examples, the heating elements 121, 122 may be infrared heaters. In other examples, induction heaters, laser heaters or resistive heaters may be used.

Heating some specific zones can compensate for the heat dissipation and therefore the temperature at which the blank 220 has been heated in the furnace, i.e. furnace temperature ($T_f$), may be maintained. On the contrary, the zones exposed to room temperature, i.e. unheated zones, gradually decrease their temperature. Additionally, in some examples, cool air may be blown to increase the cooling rate of the unheated zones. Due to the dissimilar cooling rates, zones with different mechanical properties may be achieved. This is further illustrated schematically in FIGS. 2*a* and 2*b*.

Figure 2A:
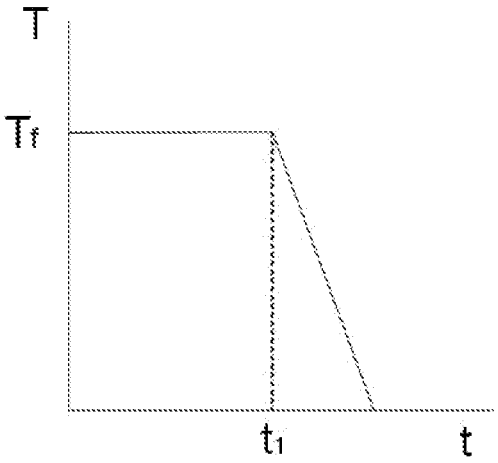
FIGS. 2*a* and 2*b* schematically illustrate temperature variation in different blank zones according to an example.

FIG. 2*a* shows how the temperature of a zone that is destined to be a hard zone varies according to an example. The horizontal axis represents time (t) while the vertical axis represents temperature (T). Initially, the zone to be a hard zone is at the temperature at which the blank exits the furnace. i.e. furnace temperature ($T_f$), which may be e.g. of about 900° C. The furnace temperature ($T_f$) is maintained until the blank is quenched at $t_1$. As a consequence of the furnace temperature being maintained, a rapid temperature change occurs when the blank is quenched. In examples, the rapid temperature change may occur from above Ms temperature to below Mf temperature.

A high temperature gradient enables the formation of microstructures having high tensile strength e.g. martensite. In other words, zones with a high temperature gradient would become hard zones.

Figure 2B:
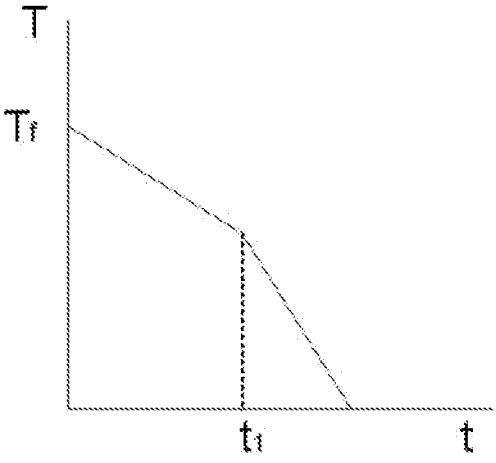

FIG. 2*b* represents how the temperature of a zone to destined to be a soft zone, i.e. lower tensile strength and more ductility than a hard zone, varies according to an example. Again, the horizontal axis represents time (t) and the vertical axis represents temperature (T). At t=0, the zone to be a soft zone is at furnace temperature ($T_1$).

However, as the zone is exposed to room temperature, i.e. It is not heated, the temperature slowly decreases until the blank is more rapidly cooled at $t_1$.

When a zone to be softened is rapidly cooled thanks to e.g. water channels in the press tool, the temperature gradient may be a bit lower than in the other zones i.e. hard zones.

Moreover, the temperature at which this rapid cooling begins is lower than for the other (harder) zones. Such a reduced temperature gradient and particularly a lower starting temperature for rapid cooling enable the creation of microstructures with low tensile strength e.g. ferrite-perlite. Soft zones are consequently created.

In particular examples, the temperature for the soft zones when rapid cooling starts, may be below Ms.

Continuing with the description of FIG. 1, after a selective heating, the blank 220 may be transferred to a press tool 250 by a transferring system (not shown), e.g. an industrial transfer robot, which may pick up the blank 220 from the conveyor system 230 and may place it on the pressing tool 250. The transfer robot may comprise a plurality of gripping units to grab and pick up the blank 220 from the conveyor means 230.

In some examples, a plurality of blanks may be processed simultaneously in a single or in parallel hot forming production lines. In such cases, a single transfer robot may comprise several groups of gripping units, each group configured for picking up a blank, i.e. a single transfer robot can pick up more than one blank at the same time.

In other examples where a plurality of blanks is processed, a plurality of transfer robots may be provided. In such examples each transfer robot may be configured to pick up a single blank.

An industrial transfer robot is an automatically controlled, (re)programmable, and optionally multipurpose robot which may be programmable in three or more axes and which may be either fixed in place or mobile for use in industrial automation applications (as defined by the International Organization for Standardization in ISO 8373).

After being centered and positioned, the blank 220 may thus be transferred to a press tool 250 for forming and quenching.

The pressing tool 250 may be provided with cooling means e.g. water suppliers or any other suitable means, to quench the blank 220 simultaneously to the hot forming process.

An aspect of the systems and methods disclosed herein is that the cooling in the press tool does not need to be adapted locally. The cooling or quenching may be done homogeneously for the whole blank. Typically, channels may be provided in the dies of the press tool through which cold water or other liquid may be conducted. This cools the contact surfaces of the press tool so that the blanks are quenched or rapidly cooled.

The upper and lower dies of a press tool may typically comprise a plurality of die blocks. Cooling channels may be provided in some or all of the die blocks to obtain the desired temperature cycle for the soft and hard zones.

Figure 3A:
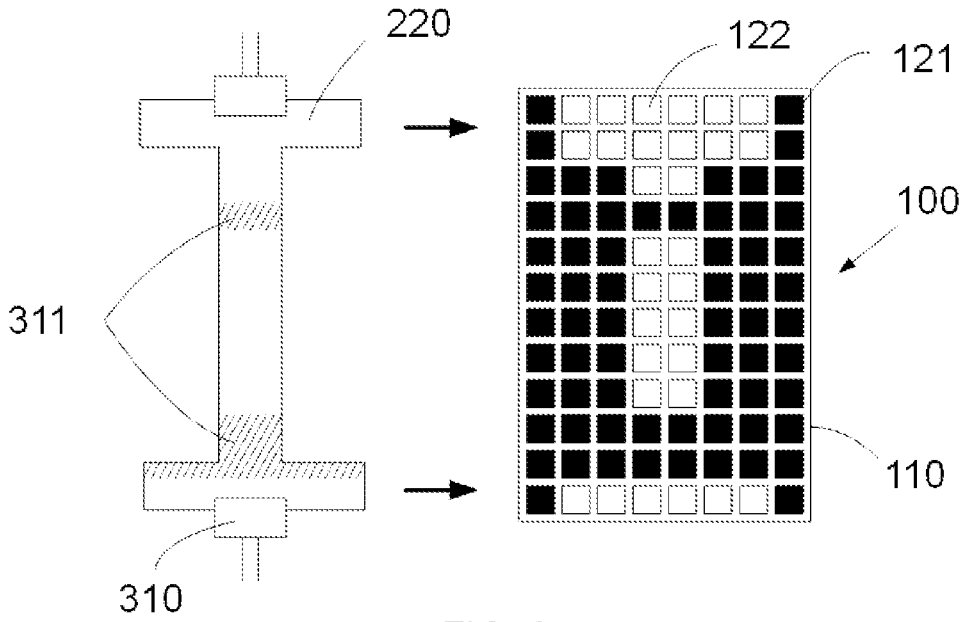
FIG. 3*a* schematically illustrates a B-pillar blank and a heating device according to an example.

FIG. 3*a* shows a blank 220, in this example a blank which is to be formed to become a B-pillar, being transported by gripping units 310 of an industrial transferring robot. The heating system 100 in this example comprises 96 individual heating elements 121, 122 arranged in a rectangular base 110. However, the number, size and shape of heating elements 121, 122 may vary depending on e.g. the blank size or the desired blank configuration. Accordingly, the base 110 of the heating system 100 may be of any suitable size and shape, which may be determined e.g. by the dimensions of the blank.

In this example, the heating elements 121, 122 may be selectively turned on and off for locally heating zones of the blank, and thereby a heating pattern is created.

The pattern may be formed by arranging the heating elements 121, 122 in a predetermined manner (see FIG. 3*b*) or it may be created by selectively switching off certain heating elements 121 while maintaining remaining heating elements 122 switched on as shown in FIG. 3*a*. The switched on heating elements 122 ensure that zones of the blank remain at a sufficiently high temperature, particularly above Ac3. In some examples, the temperature of the heated zones of the blank may be between 700° C.-1000° C., in particular between 750° C. and 930° C., optionally between 750° C. and 850° C. In some examples, the heating elements 122 that are switched on may heat the blank 220 even above furnace temperature ($T_f$).

In this depicted example the predefined pattern heats substantially the whole blank except two regions 311 of the B-pillar central beam i.e. an upper zone and a lower zone, which are to be soft zones.

After quenching, the heated zones would be transformed into hard zones due to the high temperature gradient. Accordingly, remaining unheated zones 311 would be transformed into soft zones. As a result, a double soft zone B-pillar wherein the upper soft zone is narrower that the lower soft zone would be created.

In a further example, the cooling channels may only be provided e.g. In the zones of the blank to be hardened. In that case, the zones to be hard zones would be quenched while the zones to be soft zones 311 would be cooled down.

Figure 3B:
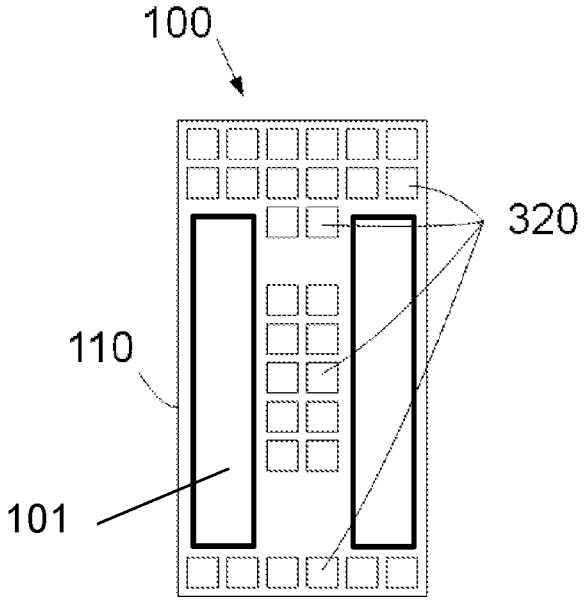
FIG. 3*b* schematically illustrates a heating device according to an example.

FIG. 3*b* shows a heating system 100 wherein the heating elements 320 are arranged in a base 110 to create a predetermined heating pattern. In this example, as in the example of FIG. 3*a*, the pattern may be configured to obtain a central B-pillar with two soft zones. Contrary to the arrangement shown in FIG. 3*a*, in FIG. 3*b* all heating elements 320 are turned on at the same time to selectively heat predetermined zones of the blank.

Figure 4:
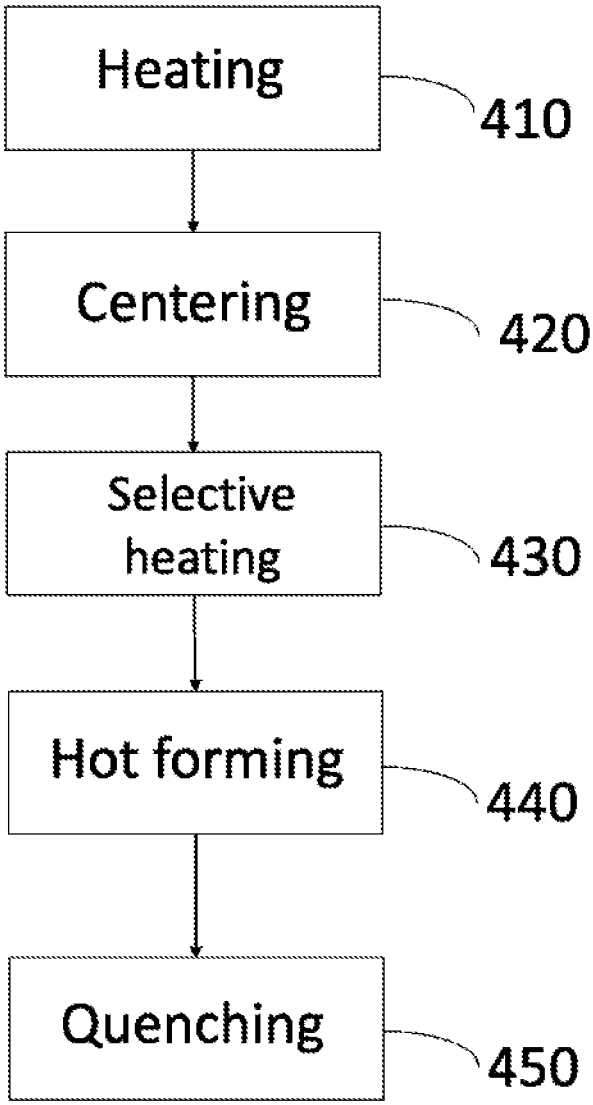
FIG. 4 schematically illustrates an example of a method for manufacturing a blank having zones with different microstructures leading to inter alia different ductility, tensile strength and hardness.

FIG. 4 shows a method to manufacture a blank according to an example. Firstly, the blank may be heated 410 in a furnace at a predetermined temperature e.g. austenization temperature, to soften the blank. The heated blank may then be transferred either with a conveyor belt or roller conveyor or a transfer robot to a centering table in which the blank may be correctly positioned and centered 420.

The centering table may comprise a heating system which may selectively heat 430 specific zones of the blank i.e. the zones to be hardened. The selective heating 430 may be carried out by heating elements which may be e.g. induction heaters or infrared heaters or laser heaters or resistive heaters.

According to an example, to selectively heat 430 certain blank zones i.e. the zones of a blank to be hardened, only those heating elements according to a pattern may be switched on.

The blank may then be transferred to a press tool in which it is hot deformed 440 to obtain the (almost) final shape. The blank may also be entirely or partially quenched 450 in the press tool e.g. by supplying cold water. Optionally the blank may further be subjected to post processing steps such as e.g. cutting, trimming, and/or joining to further components using e.g. welding.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow. If reference signs related to drawings are placed in parentheses in a claim, they are solely for attempting to increase the intelligibility of the claim, and shall not be construed as limiting the scope of the claim.

The invention claimed is:

1. A method for centering, by a centering system, blanks outputted from a furnace in a hot stamping line, wherein in the furnace the blanks are heated to a furnace temperature, the method comprising:

correcting, by a centering table of the centering system, a position of a blank after removing the blank from the furnace, heating, by applying a heating temperature with a heating system of the centering system, one or more first selected zones of the blank while arranged on the centering table, wherein the heating temperature is greater than, equal to, or less than the furnace temperature, such that (a) if the heating temperature is equal to or greater than the furnace temperature, then a temperature of the one or more first selected zones of the blank is prevented from reaching a temperature below the furnace temperature while the blank is on the centering table, or (b) if the heating temperature is less than the furnace temperature, then the temperature of the one or more first selected zones of the blank reaches a temperature below the furnace temperature while the blank is on the centering table, and wherein the heating system comprises an arrangement of heating elements, each heating element, of the arrangement of heating elements, being selectively turned on or off so as to create a preselected heating pattern to be applied to the blank, and cooling, at a temperature below the heating temperature with a cooling system of the centering system, one or more second selected zones of the blank while arranged on the centering table to cause the one or more second selected zones of the blank to reach a temperature less than the temperature of the one or more first selected zones while the blank is on the centering table, such that while the blank is on the centering table, the one or more first selected zones has a higher temperature than the one or more second selected zones.

2. The method according to claim 1, wherein the heating system comprises a base and the heating elements are arranged on the base.

3. The method according to claim 2, further comprising a support structure for coupling the base to the centering table.

4. The method according to claim 2, further comprising a support structure for anchoring the base on a floor or for suspending the base from a ceiling or from a wall.

5. The method according to any one of claims 1 and 2, wherein the heating elements are infrared heaters or induction heaters or resistive heaters or a combination thereof.

6. The method according to any one of claims 1 and 2, wherein the heating elements are laser heaters or diode laser heaters.

7. The method according to claim 1, wherein the heating system further comprises at least one contacting element, heated by the heating elements, wherein the at least one contacting element is configured to be in direct contact with the blank.

8. The method according to claim 7, wherein a temperature of the at least one contacting element that is configured to be in direct contact with the blank is configured to be operated at a range between 850 to 1000° C.

9. A method for centering, by a centering system, blanks outputted from a furnace in a hot stamping line, wherein in the furnace the blanks are heated to a furnace temperature, the method comprising:

correcting, by a centering table of the centering system, a position of a blank after removing the blank from the furnace, heating, by applying a heating temperature with a heating system of the centering system, one or more first selected zones of the blank while arranged on the centering table, wherein the heating temperature is greater than, equal to, or less than the furnace temperature, such that (a) if the heating temperature is equal to or greater than the furnace temperature, then a temperature of the one or more first selected zones of the blank is prevented from reaching a temperature below the furnace temperature while the blank is on the centering table, or (b) if the heating temperature is less than the furnace temperature, then the temperature of the one or more first selected zones of the blank reaches a temperature below the furnace temperature while the blank is on the centering table, and wherein the heating system comprises an arrangement of heating elements that are arranged with respect to the centering table in selected areas of the centering table and are excluded with respect to remaining areas of the centering table such that the one or more first selected zones of the blank are heated, and cooling, at a temperature below the heating temperature with a cooling system of the centering system, one or more second selected zones of the blank while arranged on the centering table to cause the one or more second selected zones of the blank to reach a temperature less than the temperature of the one or more first selected zones while the blank is on the centering table, such that while the blank is on the centering table, the one or more first selected zones has a higher temperature than the one or more second selected zones.

10. A method for manufacturing a steel component having hard zones and soft zones, wherein the soft zones are of less mechanical strength than the hard zones, the method comprising:

heating a steel blank in a furnace;

centering the heated blank on the centering table of the centering system according to claim 1 or 9 arranged downstream from the furnace;

applying the heat to the one or more first selected zones of the heated blank while the blank is on the centering table, wherein the one or more first selected zones are the zones of the blank to form the hard zones;

transferring the blank to a press tool;

hot forming the blank in the press tool; and quenching the one or more first selected zones of the blank to form the hard zones.

11. The method according to claim 10, wherein heating the blank in the furnace comprises heating the blank above an Ac3 temperature of the steel of the blank.

12. The method according to claim 10, wherein applying the heat to the one or more first selected zones of the heated blank comprises heating the one or more first selected zones above a heating temperature of the furnace.

13. The method according to claim 10, wherein applying the heat to the one or more first selected zones of the heated blank while the blank is on the centering table further comprises cooling the one or more second selected zones of the blank with the cooling system.

14. The method according to claim 10, wherein the blanks remain on the centering table for a period of 15 seconds or less.

15. The method according to claim 13, wherein the one or more second selected zones of the blank has a temperature ranging between 450° C. and 700° C. when the blank is transferred to the press tool.

16. The method according to claim 10, wherein a temperature of the blank in the press tool is reduced to 250° C. or lower.

* * * * *